US007329787B2

(12) United States Patent
Briot et al.

(10) Patent No.: US 7,329,787 B2
(45) Date of Patent: Feb. 12, 2008

(54) PROCESS FOR TRANSFORMING HYDROCARBONS INTO A FRACTION HAVING AN IMPROVED OCTANE NUMBER AND A FRACTION WITH A HIGH CETANE INDEX

(75) Inventors: Patrick Briot, Pommier de Beaurepaire (FR); Vincent Coupard, Vaulx en Velin (FR); Alain Forestiere, Vernaison (FR); Eric Llido, Communay (FR)

(73) Assignee: Institut Francais du Petrole, Rueil Malmaison Cedex (FR)

( * ) Notice: Subject to any disclaimer, the term of this patent is extended or adjusted under 35 U.S.C. 154(b) by 599 days.

(21) Appl. No.: 10/740,685

(22) Filed: Dec. 22, 2003

(65) Prior Publication Data

US 2004/0186331 A1 Sep. 23, 2004

(30) Foreign Application Priority Data

Dec. 23, 2002 (FR) ..... 02 16474

(51) Int. Cl.
*C07C 2/04* (2006.01)
*C07C 5/03* (2006.01)
*C07C 5/00* (2006.01)

(52) U.S. Cl. ..... 585/329; 585/254; 585/264; 585/327; 585/330

(58) Field of Classification Search ..... 585/250, 585/254, 264, 275, 310, 329, 330, 502, 520, 585/530, 640, 327
See application file for complete search history.

(56) References Cited

U.S. PATENT DOCUMENTS

| | | | | |
|---|---|---|---|---|
| 2,925,379 | A * | 2/1960 | Fleck et al. | 208/254 R |
| 4,528,411 | A * | 7/1985 | Hutson, Jr. | 585/329 |
| 5,382,705 | A * | 1/1995 | Chung et al. | 568/697 |
| 6,028,239 | A | 2/2000 | Marion et al. | |
| 6,074,982 | A | 6/2000 | Bister et al. | |
| 6,100,438 | A * | 8/2000 | Marion et al. | 585/639 |

FOREIGN PATENT DOCUMENTS

| | | |
|---|---|---|
| EP | 0237372 | 9/1987 |
| EP | 0332243 | 9/1989 |
| EP | 0659723 | 6/1995 |

* cited by examiner

*Primary Examiner*—Jill Warden
*Assistant Examiner*—Randy Boyer
(74) *Attorney, Agent, or Firm*—Millen, White, Zelano & Branigan, P.C.

(57) ABSTRACT

A process is described for transforming an initial hydrocarbon feed containing 4 to 15 carbon atoms, limits included, into a hydrocarbon fraction having an improved octane number and a hydrocarbon fraction with a high cetane number.

17 Claims, 2 Drawing Sheets

PROCESS FOR TRANSFORMING HYDROCARBONS INTO A FRACTION HAVING AN IMPROVED OCTANE NUMBER AND A FRACTION WITH A HIGH CETANE INDEX

The present invention relates to a process that allows simple and economical modulation of the respective production of gasoline and gas oil in the refinery, for example. More preferably, in accordance with the process of the present invention, it is possible to transform an initial feed of hydrocarbons containing 4 to 15 carbon atoms, limits included, preferably 4 to 11 carbon atoms, limits included, or even 4 to 10 carbon atoms, limits included, into at least one hydrocarbon having an improved octane number and a hydrocarbon fraction with a high cetane index.

It is known (from "Carburants et Moteurs" [Fuels and Engines], by J C Guibet, Editions Technip, vol. I (1987)) that the chemical nature of olefins contained in gasoline makes a major contribution to the octane number of that gasoline. In general, those olefins can be classified for that reason into two distinct categories:

a) branched olefins: they have good octane numbers. That octane number increases with the degree of branching and reduces with chain length;

b) linear olefins: they have a low octane number and that octane number reduces rapidly with chain length.

Other different processes for transforming olefins to increase their octane number are known.

An example that can be cited is aliphatic alkylation between paraffins and olefins to produce high octane number gas cuts. That process can employ mineral acids such as sulfuric acid ("Symposium on Hydrogen Transfer in Hydrocarbon Processing", 208$^{th}$ National Meeting, American Chemical Society—August 1994), or catalysts that are soluble in a solvent (European patent EP-A-0 0 714 871) or heterogeneous catalysts (United States patent U.S. Pat. No. 4,956,518). Examples are processes involving the addition, to isobutane (branched alkane), of alkenes containing 2 to 5 carbon atoms to produce highly branched molecules containing 6 to 9 carbon atoms and generally characterized by high octane numbers.

Other possible transformations are known which employ processes for etherification of branched olefins, such as those described in U.S. Pat. No. 5,633,416 and European patent application EP-A-0 451 989. Those processes can produce ethers of the MTBE (methyl tertio butyl ether), ETBE (ethyl tertio butyl ether) and TAME (tertio amyl methyl ether) type, which are well known to improve the octane number of gasoline.

In a third route, oligomerization processes, essentially based on dimerization and trimerization of light olefins from a catalytic cracking process and containing 2 to 4 carbon atoms, can produce gasoline cuts or distillates. Such a process has, for example, been described in EP-A-0 734 766. It principally produces products containing 6 carbon atoms when the olefin employed is propylene (propene) and 8 carbon atoms when the olefin is linear butene. Those oligomerization processes are known to produce gasoline cuts with good octane numbers but when carried out under conditions encouraging the formation of heavier cuts, they generate gas oil cuts with very low cetane indices. Examples are those illustrated by U.S. Pat. No. 4,456,779 and U.S. Pat. No. 4,211,640.

U.S. Pat. No. 5,382,705 proposes coupling the oligomerization and etherification processes described above to produce, from a $C_4$ cut, tertiary alkyl ethers such as MTBE or ETBE and lubricants.

The effluents from processes for converting heavy or lighter residues from atmospheric distillation or vacuum distillation of crude oil in the refinery (such as gasoline cuts from a fluidized bed catalytic cracking process, FCC) have an olefin content in the range 10% to 80%. Those effluents form part of the compositions of commercial gasoline in amounts of 20% to 40% depending on the geographical origin (about 27% in Western Europe and about 36% in the USA). That amount essentially varies as a function of the end point of the gasoline cut and on the refinery.

It is highly probable that in the context of environmental protection, standards concerning commercial gasoline will in future be oriented towards a reduction in the permitted amount of olefins in the gasoline.

The above points lead to the conclusion that the production of gasoline with a low olefins content but retaining an acceptable octane number can only be carried out by selecting branched olefins with a high octane number as the base for the gasoline, either exclusively or in very high proportions. One of the aims of the present invention is to separate linear olefins from branched olefins in an initial gasoline feed.

Further, the current automobile market is tending towards a higher proportion of diesel vehicles, causing increased demand for gas oil fuel. The invention also aims to provide an alternative allowing increased flexibility of the management of refinery products. More precisely, the process of the present invention advantageously allows the gasoline/gas oil proportions obtained to be modified at the refinery outlet depending on market demands.

The invention concerns a process for transforming a hydrocarbon feed comprising linear and branched olefins containing 4 to 15 carbon atoms, said process comprising the following steps:

a) selectively etherifying the majority of the branched olefins present in said feed;

b) treating the linear olefins contained in said feed under moderate oligomerization conditions;

c) separating the effluent from step b) into at least two cuts:

a β cut comprising hydrocarbons with an end point that is below a temperature in the range 150° C. to 200° C.;

a γ cut at least partially comprising hydrocarbons with an initial boiling point higher than a temperature in the range 150° C. to 200° C.;

d) treating the hydrocarbon fraction containing the ethers formed during step a) under conditions for cracking ethers at least partially, said treatment being followed by separation into a gasoline fraction with an improved octane number and into a fraction containing the initial alcohol;

e) hydrogenating the γ cut under conditions for producing a gas oil with a high cetane index.

In step a) of the process of the invention, at least 50% of the branched olefins, preferably at least 70% and highly preferably at least 90% of said olefins are etherified.

The end point of the 0 cut usually corresponds to the initial boiling point of the γ cut.

In a first implementation of the invention, all of the effluent from step a) is treated in step b) and the c cut comprises the ethers formed during step a).

In a second implementation of the invention, the process further comprises a step for separating ethers from the remainder of the effluent from step a), said effluent which has been freed of said ethers being treated in accordance with step b) and said ethers being treated with the β cut in accordance with step d).

All of the ethers in the β cut can be cracked during step d). In a further implementation of the present invention, the experimental conditions are selected so that a variable proportion of the ethers included in the β-cut can be cracked during step d). Typically, said portion can be in the range 85% to 99.9% molar, or even in the range 90% to 99.9% molar.

Usually, said oligomerization is carried out at a pressure in the range 0.2 to 10 MPa, with a ratio of the flow rate of the feed to the volume of the catalyst in the range 0.05 to 50 l/l/h and at a temperature in the range 15° C. to 300° C.

As an example, said oligomerization can be carried out in the presence of a catalyst comprising at least one metal from group VIB of the periodic table.

Usually, said etherification is carried out at a pressure in the range 0.2 to 10 MPa, a ratio of the flow rate of the feed to the volume of catalyst in the range 0.05 to 50 l/l/h and at a temperature in the range 15° C. to 300° C.

The present process can also comprise a step for at least partial elimination of nitrogen-containing or basic impurities contained in the initial hydrocarbon feed.

As an example, the initial hydrocarbon feed treated in the present process can derive from a process for catalytic cracking, catalytic reforming or dehydrogenation of paraffins.

Figure 1:
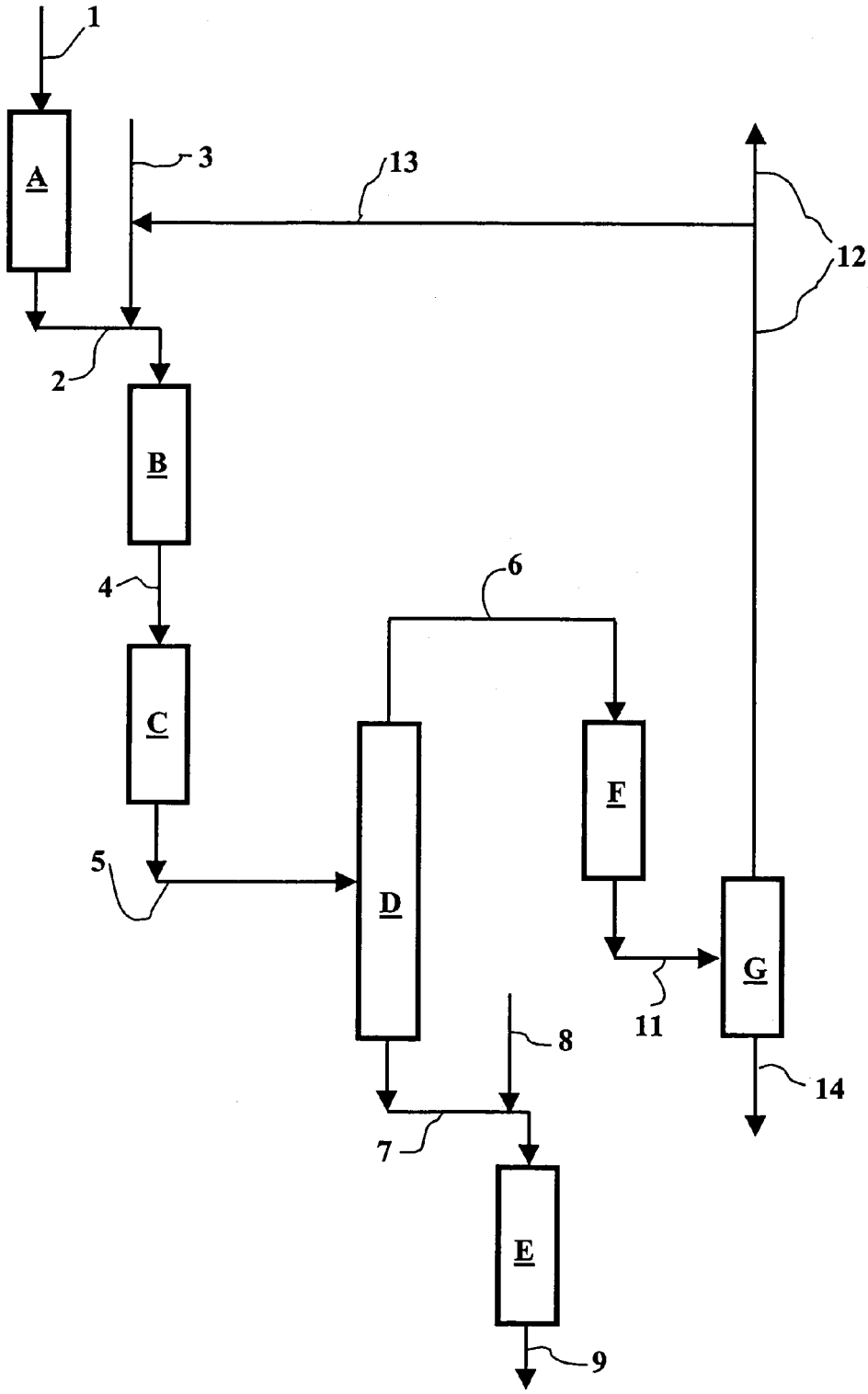
FIG. 1 is a flowsheet of an embodiment of the invention.

The invention will be better understood from the following description of a non-limiting implementation of said invention, illustrated in FIG. 1.

In FIG. 1, the initial hydrocarbon feed is routed via a line 1 to a unit A. That unit A can eliminate a high proportion, i.e. at least 90% by weight, of the nitrogen-containing and/or basic compounds contained in the feed. That elimination, although optional, is recommended when the feed contains a large amount, i.e. at least 5 ppm, of those nitrogen-containing and/or basic compounds as they constitute a poison for the catalysts in the subsequent steps of the process of the invention. Said compounds can be eliminated by adsorption onto an acidic solid. That solid can be selected from the group formed by zeolites, silicoaluminates, titanosilicates, mixed oxides of alumina and titanium oxide, clays, resins, mixed oxides obtained by grafting at least one organosoluble or aquosoluble organometallic compound and comprising at least one element selected from the group formed by titanium, zirconium, silicon, germanium, tin, tantalum and niobium on at least one oxide support such as alumina (gamma, delta, eta forms, used alone or as a mixture), silica, silica aluminas, silica-titanium oxides, zirconia silicas, ion exchange resins, for example sulphonated styrene-divinylbenzene resins such as Amberlyst® type resins or any other acid resin. In one particular implementation, the invention can consist of using a physical mixture of at least two of the solids described above.

The pressure is in the range from atmospheric pressure to 10 MPa, preferably between atmospheric pressure and 5 MPa, and preferably a pressure is selected at which the feed is in the liquid state. The ratio of the flow rate of the feed to the volume of the catalytic solid is usually between 0.05 l/l/h and 50 l/l/h and preferably between 0.1 l/l/h and 20 l/l/h, or even between 0.2 l/l/h and 10 l/l/h. The temperature is between 15° C. and 300° C., preferably between 15° C. and 150° C. and highly preferably between 15° C. and 60° C.

The scope of the invention includes eliminating nitrogen-containing and/or basic compounds contained in the feed by washing with an aqueous acidic solution, or by any equivalent means known in the art.

The purified feed is routed via a line 2 to an etherification unit B corresponding to step a) of the process of the invention. In said unit B, branched olefins preferentially react with an alcohol to form an ether. The alcohol is preferably methanol or ethanol and can be added, via a line 3, to the hydrocarbon feed in a mole ratio of alcohol/olefins that is generally in the range 0.5 to 3, preferably about 1. Usually, the pressure in the unit is such that at the temperature at which the catalyst used in said step a) of the process of the invention, the feed is in the liquid state, i.e., the pressure is in the range 0.2 MPa to 10 MPa, preferably in the range 0.3 to 6 MPa, or even in the range 0.3 to 4 MPa. The ratio of the flow rate of the feed to the volume of the catalyst is generally in the range 0.05 l/l/h to 50 l/l/h, preferably in the range 0.1 l/l/h to 20 l/l/h, or even in the range 0.2 l/l/h to 10/l/l/h. The temperature is in the range 15° C. to 300° C., preferably in the range 30° C. to 150° C. and more preferably in the range 30° C. to 100° C.

Etherification unit B advantageously contains an acid catalyst. The acid catalyst can be a catalyst with the same nature as those conventionally used for the production of MTBE, ETBE or TAME. As an example, it can be selected from the group formed by zeolites, silicoaluminates, titanosilicates, mixed oxides of alumina and titanium oxide, clays, resins, mixed oxides obtained by grafting and comprising at least one element selected from the group formed by titanium, zirconium, silicon, germanium, tin, tantalum and niobium on at least one oxide support such as alumina (gamma, delta, eta forms, used alone or as a mixture), silica, silica aluminas, silica-titanium oxides, zirconia silicas, ion exchange resins of the Amberlyst type or any other acid resin. In one particular implementation, the invention can consist of using a physical mixture of at least two of the catalysts described above.

The effluent from etherification unit B is then optionally treated under conditions for eliminating at least a portion of the excess alcohol contained in the mixture obtained. That elimination can be carried out conventionally by washing with water or by any equivalent means known in the art.

In a preferred mode of the invention, all of the effluent from etherification unit B is sent to an oligomerization unit C corresponding to step b) of the process of the invention, without intermediate ether separation. The linear olefins present in the initial hydrocarbon feed and which have not reacted during the preceding etherification step will undergo moderate oligomerization reactions, i.e. generally dimerizations or trimerizations, the conditions of said reaction being optimized to the production of a majority of hydrocarbons the number of carbon atoms of which is in the range 9 to 25, preferably in the range 10 to 20. The catalyst from oligomerization unit C can be selected from the group formed by zeolites, silicoaluminates, titanosilicates, mixed oxides of alumina and titanium oxide, clays, resins, mixed oxides obtained by grafting at least one organosoluble or aquosoluble organometallic compound and comprising at least one element selected from the group formed by titanium, zirconium, silicon, germanium, tin, tantalum and niobium on at least one oxide support such as alumina (gamma, delta, eta forms, used alone or as a mixture), silica, silica aluminas, silica-titanium oxides, zirconia silicas, or any other solid with any acidity. Preferably, the catalyst used to carry out said oligomerization comprises at least one metal from group VIB of the periodic table and advantageously an oxide of said metal. The catalyst can further comprise an oxide support selected from the group formed by aluminas, titanates, silicas, zirconias, and aluminosolicates. In one particular implementation, the invention can consist of using a physical mixture of at least two of the solids described above.

Surprisingly, it has been found that the experimental conditions employed in oligomerization unit C have a considerable influence not only on the final yield of the different products from the oligomerization reaction, but also on the quality of said products, in particular on the cetane index of the gas oil cut and on the octane number of the gasoline cut finally obtained. The RON of the gasoline cut finally obtained is advantageously at least 93, preferably at least 95. The cetane index of the gas oil cut is advantageously at least 40, preferably at least 50 and more preferably at least 55.

In particular, the pressure of the oligomerization unit C is usually selected so that the feed is in the liquid form. In principle, that pressure is in the range 0.2 MPa to 10 MPa, preferably in the range 0.3 to 6 MPa, and more preferably in the range 0.3 to 4 MPa. The ratio of the flow rate of the feed to the volume of the catalyst (also known as the hourly space velocity, HSV) can be in the range 0.05 l/l/h to 50 l/l/h, preferably in the range 0.1 l/l/h to 20 l/l/h and more preferably in the range 0.2 l/l/h to 10 l/l/h. The Applicant has discovered that, under those pressure and HSV conditions, the oligomerization reaction temperature should be in the range 15° C. to 300° C., preferably in the range 60° C. to 250° C. and more particularly in the range 100° C. to 200° C. to optimize the quality of the products finally obtained.

The effluent from unit C is then sent via a line 5 to one or more distillation columns (unit D), a flash drum or any other means that is known in the art to separate the hydrocarbon effluents into at least two distinct cuts by their boiling points:

- a β cut, the light cut, the end point for which is in the range 150° C. to 200° C., preferably in the range 150° C. to 180° C. This cut is transported via line 6;
- a γ cut, the heavy cut, the end point for which is in the range 150° C. to 200° C., preferably in the range 150° C. to 180° C. This cut is transported via line 7.

In accordance with the invention, the end point for the β cut advantageously corresponds to the initial distillation point for the γ cut.

The heavy γ cut is a cut the initial boiling point of which corresponds to a gas oil cut. That cut can be mixed with hydrogen, routed via a line 8, for hydrogenation in a hydrogenation unit E of conventional structure in the presence of a catalyst and under operating conditions that are known to the skilled person. The hydrocarbon-containing effluent recovered via line 9 is a gas oil with an improved cetane index, i.e. with a cetane index of at least 40, preferably at least 50 and more preferably at least 55.

The light β cut is a gasoline cut and is routed via a line 6 to a cracking unit F corresponding to step d) of the process of the invention. In unit F, in one possible implementation of the invention, the conditions are selected so that all of the ethers present in the β cut are cracked into a hydrocarbon fraction comprising olefins, principally branched olefins, and a fraction comprising the initial alcohol. In a further implementation of the invention, the cracking conditions can be adjusted so that only a portion of said ethers is cracked. That mode can advantageously further improve the octane number of the final gasoline fraction, but is limited, however, by current legislation in many states concerning the amount of oxygen-containing compounds in the gasoline. Typically, that portion can be in the range 85% to 99.9% molar, or even in the range 90% to 99.9% molar.

The pressure of cracking unit F is in the range 0.2 to 10 MPa, preferably in the range 0.3 to 6 MPa, or even in the range 0.3 to 4 MPa. The ratio of the flow rate of the feed to the volume of catalyst is in the range 0.05 l/l/h to 50 l/l/h, preferably in the range 0.1 l/l/h to 20 l/l/h and more preferably in the range 0.2 l/l/h to 10 l/l/h. The temperature is generally over 15° C., and usually in the range 15° C. to 350° C., preferably in the range 100° C. to 350° C.

The catalyst used in cracking unit F can be an acid catalyst selected from the group formed by zeolites, silicoaluminates, titanosilicates, mixed oxides of alumina and titanium oxide, clays, resins, mixed oxides obtained by grafting at least one organosoluble or aquosoluble organometallic compound and comprising at least one element selected from the group formed by titanium, zirconium, silicon, germanium, tin, tantalum and niobium on at least one oxide support such as alumina (gamma, delta, eta forms, used alone or as a mixture), silica, silica aluminas, silica-titanium oxides, zirconia silicas, ion exchange resins of the Amberlyst® type or any other solid with any acidity. In one particular implementation, the invention can consist of using a physical mixture of at least two of the solids described above.

The effluent from cracking unit F is routed via a line 11 to a unit G that can separate the alcohols from the hydrocarbons and ethers that are not cracked during the preceding step. That unit G can be a distillation column, a thermal diffusion column or a known water washing means or any other means known to the skilled person for separating alcohols and hydrocarbons. The alcohol can be recycled via a line 13 to the inlet to the etherification unit B or sent to a storage tank via a line 12.

The hydrocarbon effluent recovered via a line 14 is a gasoline with an improved octane number and an olefin content that is lower than that of the initial hydrocarbon feed. The olefin content is advantageously reduced by at least 40% by weight, more advantageously by at least 50% by weight.

In a further implementation of the invention, the ethers contained in the effluent from etherification unit B can be separated from the hydrocarbon cut. Units C and D then treat an effluent that is free of substantially all ethers. The gasoline obtained in this case at the outlet from unit D can be mixed with ethers when the ethers have been withdrawn after etherification unit B. This cut can then be sent to cracking unit F and to separation unit G. However, in that implementation, because of the similarity of the physical properties and in particular the boiling points of the compounds contained in the effluent from etherification unit B, separating ethers from the remainder of the hydrocarbons present in said effluent can only be carried out effectively using means that are generally expensive and/or difficult to operate. An example that can be cited are liquid-liquid extraction processes, which impose the use of large proportions of solvents or adsorption onto solids, which is not compatible with treatment at high throughputs. In a preferred implementation of the invention described above, the Applicant has discovered that it is possible, under certain conditions (such as those described in the present description), to send all of the effluent from etherification unit B to oligomerization unit C. At the outlet from said unit C, a conventional cheaper distillation means such as a distillation column or a flash drum can effectively be employed to fractionate the mixture.

The following examples illustrate the advantages of the present invention.

EXAMPLE 1

In this example, the initial feed I was a FCC gasoline with a boiling point in the range 40° C. to 150° C. That gasoline contained 10 ppm of basic nitrogen. The feed was sent to a reactor A containing a solid constituted by a mixture of 20% alumina and 80% by weight of mordenite type zeolite. The zeolite used in the present example has a silicon/aluminium ratio of 45.

The pressure of the unit was 0.2 MPa; the ratio of the liquid flow rate of the feed to the volume of acidic solid was 1 litre/litre/hour. The reactor temperature was 20° C.

Table 1 shows the composition of the initial feed I and that of the effluent A from unit A.

TABLE 1

Composition of feed and effluent from step A

| | Feed I | Effluent A |
|---|---|---|
| Nitrogen (ppm) | 10 | 0.2 |
| Paraffins (wt %) | 25.2 | 25.1 |
| Naphthenes (wt %) | 9.6 | 9.8 |
| Aromatics (wt %) | 34.9 | 35 |
| Olefins (wt %) | 30.3 | 30.1 |

Effluent A was then sent to an etherification reactor B containing an Amberlyst 15 ion exchange resin as sold by Rohm & Haas. Methanol was added to that product in a ratio of 1 mole of methanol per mole of olefin. The pressure in unit B was 3 MPa. The ratio of the flow rate of the feed to the volume of catalyst was 1 litre/litre/hour. The temperature was 90° C. Table 2 shows the composition of effluent B leaving unit B compared with that of effluent A.

TABLE 2

Composition of effluents A and B

| | Effluent A | Effluent B |
|---|---|---|
| Paraffins (wt %) | 25.1 | 25.1 |
| Naphthenes (wt %) | 9.8 | 9.8 |
| Aromatics (wt %) | 35 | 35 |
| Olefins (wt %) | 30.1 | 18.5 |
| Ethers (wt %) | 0 | 11.8 |

Effluent B was injected into an oligomerization reactor C containing a catalyst constituted by a mixture of 50% by weight of zirconia and 50% by weight of $H_3PW_{12}O_{40}$. The pressure in the unit was 2 MPa; the ratio of the feed flow rate to the volume of catalyst was 1.5 litre/litre/hour. The temperature was fixed at 170° C. An effluent C was obtained at the outlet from unit C. The respective olefin contents of effluents A, B and C as a function of the number of carbon atoms are shown in Table 3.

TABLE 3

Olefin contents of effluents A, B, C

| | Effluent A | Effluent B | Effluent C |
|---|---|---|---|
| C5 olefins (wt %) | 1.05 | 0.63 | 0.01 |
| C6 olefins (wt %) | 2.80 | 1.71 | 0.1 |
| C7 olefins (wt %) | 8.75 | 5.34 | 0.3 |
| C8 olefins (wt %) | 14 | 8.55 | 1.6 |
| C9 olefins (wt %) | 3.7 | 2.26 | 0.68 |

Figure 2:
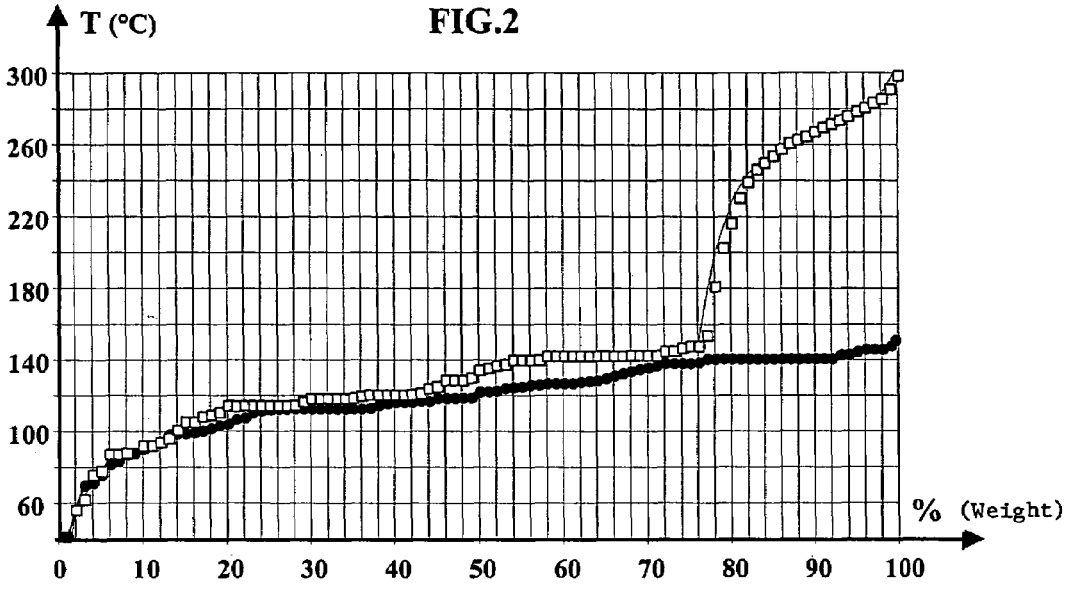
FIGS. 2 and 3 are graphs of boiling point vs. percent by weight of effluent.

FIG. 2 compares simulated distillation of the initial feed (black circles) and of the effluent C (white squares). It can be seen that 24% by weight of the effluent boiled at a temperature of more than 150° C., the end point for the initial feed.

Effluent C was distilled into 2 cuts in a distillation unit D:

- a light cut β with a distillation interval of 40° C.-200° C., in a yield of 78 weight %;
- a heavy γ cut comprising hydrocarbons with an initial point of more than 200° C. and a yield of 22 weight %.

Said heavy γ cut was sent to a hydrogenation reactor E containing a catalyst comprising an alumina support on which nickel and molybdenum had been deposited. The pressure of unit E was 5 MPa; the ratio of the flow rate of the feed to the volume of catalyst was 2 litre/litre/hour. The ratio of the flow rate of the injected hydrogen to the flow rate of the feed was 600 litre/litre. The reactor temperature was 320° C. The characteristics of effluent E from unit E are shown in Table 4.

TABLE 4

Characteristics of effluent from unit E

| | Effluent E |
|---|---|
| Density at 20° C. (kg/l) | 0.787 |
| Motor cetane index | 55 |

The light β cut with a distillation interval of 40° C.-200° C. from unit D was injected into a cracking reactor F containing Deloxan sold by Degussa. That catalyst was a polysiloxane grafted with alkylsulphonic acid type groups (of the type $CH_2$—$CH_2$—$CH_2SO_3H$). The pressure in the unit was 3 MPa. The ratio of the flow rate of the feed to the volume of catalyst was 3 litre/litre. The temperature was 200° C.

The characteristics of the gasoline cut G from unit F and after separating the methanol by extraction with water can be compared with those of the initial feed I by referring to Table 5.

TABLE 5

Comparison of characteristics of initial feed I and final effluent G

| | Initial feed I | Effluent G |
|---|---|---|
| Paraffins (wt %) | 25.2 | 30.9 |
| Naphthenes (wt %) | 9.6 | 11.8 |
| Aromatics (wt %) | 34.9 | 42.8 |
| Olefins (wt %) | 30.3 | 14.5 |
| RON octane number | 92 | 95 |

It can be seen that the present process can simply and cheaply produce from a gasoline cut, i.e. using conventional and cheap technology, a gas cut (effluent G) with a low olefins content and an improved octane number and a gas oil cut (effluent E) with a high cetane index, compatible with commercial use.

EXAMPLE 2

Figure 3:
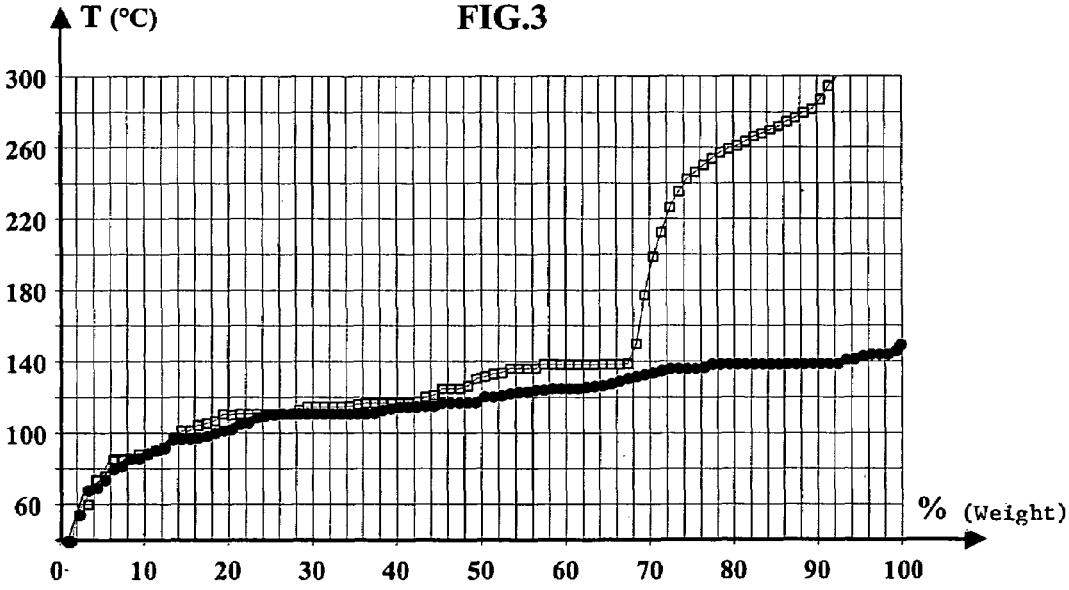

In this example, the same initial feed I was treated in units A and B under conditions identical to those of Example 1. Effluent B obtained was introduced into the reactor C comprising the same catalyst and under the same conditions as those for Example 1 with the exception that this time, the temperature in said reactor C was raised to 350° C. An effluent C' was obtained at the outlet from reactor C containing zero or less than 0.02% of C5 to C9 olefins. FIG. 3 compares simulated distillation of the initial feed (black circles) and of effluent C' (white squares). This time, it can be seen that 32 weight % of effluent C' boils at a temperature of more than 150° C., the end point for the initial feed.

Effluent C' was then distilled into 2 cuts:

a light cut β with a distillation interval of 40° C.-200° C. with a yield of 70 weight %;

a heavy cut γ' comprising hydrocarbons with an initial point of more than 200° C. and a yield of 30 weight %.

Said heavy cut γ was sent to reactor E containing the same catalyst as that used in Example 1 (alumina support on which nickel and molybdenum had been deposited). The pressure in the unit was 5 MPa; the ratio of the flow rate of the feed to the volume of catalyst was 2 litre/litre/hour. The ratio of the flow rate of the injected hydrogen to the flow rate of the feed was 600 litre/litre. The reactor temperature was 320° C. The characteristics of effluent E' from unit E are shown in Table 6.

TABLE 6

Characteristics of effluent E' from unit E

| | Effluent E' |
|---|---|
| Density at 20° C. (kg/l) | 0.787 |
| Sulphur (ppm) | 10 |
| Motor cetane index | 35 |

It can be seen that the cetane index of the gas oil obtained when oligomerization was carried out at a higher temperature (350° C.) was substantially lower than that obtained when oligomerization was carried out at a lower temperature (170° C.). The gas oil derived from oligomerization at 350° C. was not suitable for commercialization, which was not the case with that obtained at 170° C.

The entire disclosures of all applications, patents and publications, cited herein and of corresponding French application No. 02/16.474, filed Dec. 23, 2002 are incorporated by reference herein.

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

The invenntion claimed is:

1. A process for transforming an initial hydrocarbon feed comprising linear and branched olefins containing 4 to 15 carbon atoms, said process comprising the following steps:

(y) a preliminary step of at least partially eliminating the nitrogen-containing or basic impurities contained in the initial hydrocarbon feed, a) selectively etherifying the majority of the branched olefins present in said initial hydrocarbon feed with an alcohol to obtain an effluent;

b) treating all the effluent from step (a) including the linear olefins contained in said initial hydrocarbon feed under moderate oligomerization conditions to obtain an effluent;

c) separating the effluent from step b) into at least two cuts:

a β cut having a maximum boiling point that is below a temperature in the range 150° C. to 200° C. and comprising the ethers formed during step (a);

a y cut with an initial boiling point higher than a temperature in the range 150° C. to 200° C. and at least partially comprising hydrocarbons;

d) treating a hydrocarbon fraction containing the ethers formed during step a) under conditions for cracking ethers at least partially, said treatment being followed by separation into a gasoline fraction with an improved octane number and into a fraction containing the initial alcohol;

e) hydrogenating the y cut under conditions for producing a gas oil with a high cetane index.

2. A process according to claim 1, wherein all of the ethers comprised in the β cut are cracked during step d).

3. A process according to claim 1, in which said oligomerization is carried out at a pressure in the range 0.2 to 10 MPa, with a ratio of the flow rate of the feed to the volume of the catalyst being in the range 0.05 to 50 l/l/h and a temperature in the range 15° C. to 300° C.

4. A process according to claim 1, in which said oligomerization is carried out in the presence of a catalyst comprising at least one metal from group VIB of the periodic table.

5. A process according to claim 1, in which said etherification is caffied out at a pressure in the range 0.2 to 10 MPa, at a ratio of the flow rate of the feed to the volume of catalyst being in the range 0.05 to 50 l/l/h and a temperature in the range 15° C. to 300° C.

6. A process according to claim 1, in which the initial hydrocarbon feed derives from a process for catalytic cracking, catalytic reforming or dehydrogenation of paraffins.

7. A process according to claim 1, wherein the initial hydrocarbon feed derives from a process for catalytic cracking.

8. A process according to claim 1, wherein the initial hydrocarbon feed derives from a process for catalytic reforming.

9. A process according to claim 1, wherein the oligomerization is conducted at a temperature of 100 to 200° C.

10. A process for transforming a hydrocarbon feed comprising linear and branched olefins containing 4 to 15 carbon atoms, said process comprising the following steps:

a) selectively etherifying the majority of the branched olefins present in said hydrogenation feed with an alcohol to obtain an effluent;

b) treating all the effluent from step (a) including the linear olefins contained in said feed under moderate oligomerization conditions;

c) separating the effluent from step b) into at least two cuts:

a β cut having a maximum boiling point that is below a temperature in the range 150° C. to 200° C. and comprising hydrocarbons;

a γ cut with an initial boiling point higher than a temperature in the range 150° C. to 200° C. and at least partially comprising hydrocarbons;

d) treating the hydrocarbon fraction containing the ethers formed during step a) under conditions for cracking ethers at least partially, said treatment being followed by separation into a gasoline fraction with an improved octane number and into a fraction containing the initial alcohol;

e) hydrogenating the γ cut under conditions for producing a gas oil with a high cetane index.

11. A process for transforming an initial hydrocarbon feed derived from catalytic cracking and comprising linear and branched olefins containing 4 to 15 carbon atoms, said process for transforming said initial hydrocarbon feed comprising the following steps:

(y) a preliminary step of at least partially eliminating nitrogen-containing or basic impurities contained in the initial hydrocarbon feed, a) selectively etherifying the majority of the branched olefins present in said initial hydrocarbon feed with an alcohol;

b) treating the linear olefins contained in said initial hydrocarbon feed under moderate oligomerization conditions to obtain an effluent;

c) separating the effluent from step b) into at least two cuts:

a β cut comprising hydrocarbons with an end point having a maximum boiling point that is below a temperature in the range 150° C. to 200° C. and comprising hydrocarbons;

a γ cut with an initial boiling point higher than a temperature in the range 150° C. to 200° C. and at least partially comprising hydrocarbons;

d) treating a hydrocarbon fraction containing the ethers formed during step a) under conditions for cracking ethers at least partially, said treatment being followed by separation into a gasoline fraction with an improved octane number and into a fraction containing the initial alcohol;

e) hydrogenating the y cut under conditions for producing a gas oil with a high cetane index.

12. A process according to claim 11, wherein the oligomerization is conducted at a pressure in the range of 0.3 to 6 MPa, an hourly space velocity in the range of 0.1 l/l/h to 20 l/l/h and a temperature in the range of 60 to 250° C.

13. A process according to claim 11, wherein the oligomerization is conducted at a pressure in the range of 0.3 to 4 MPa, an hourly space velocity in the range of 0.2 l/l/h to 10 l/l/h and a temperature in the range of 100 to 200° C.

14. A process according to claim 1, wherein the oligomerization is conducted at a pressure in the range of 0.3 to 6 MPa, an hourly space velocity in the range of 0.1 l/l/h to 20 l/l/h and a temperature in the range of 60 to 250° C.

15. A process according to claim 1, wherein the oligomerization is conducted at a pressure in the range of 0.3 to 4 MPa, an hourly space velocity in the range of 0.2 l/l/h to 10 l/l/h and a temperature in the range of 100 to 200° C.

16. A process according to claim 10, wherein the oligomerization is conducted at a pressure in the range of 0.3 to 6 MPa, an hourly space velocity in the range of 0.1 l/l/h to 20 l/l/h and a temperature in the range of 60 to 250° C.

17. A process according to claim 10, wherein the oligomerization is conducted at a pressure in the range of 0.3 to 4 MPa, an hourly space velocity in the range of 0.2 l/l/h to 10 l/l/h and a temperature in the range of 100 to 200° C.

* * * * *

UNITED STATES PATENT AND TRADEMARK OFFICE

CERTIFICATE OF CORRECTION

PATENT NO. : 7,329,787 B2
APPLICATION NO. : 10/740685
DATED : February 12, 2008
INVENTOR(S) : Patrick Briot It is certified that error appears in the above-identified patent and that said Letters Patent is hereby corrected as shown below:

Column 10, line 17 reads "a y cut" should read -- a β cut --
Column 10, line 25 reads "the y cut" should read -- the β cut --
Column 10, line 39 reads "caffied" should read -- carried --
Column 12, line 7 reads "the y cut" should read -- the β cut --

Signed and Sealed this

Twenty-ninth Day of July, 2008

JON W. DUDAS
*Director of the United States Patent and Trademark Office*